US006266026B1

(12) United States Patent
Stengel, Jr.

(10) Patent No.: US 6,266,026 B1
(45) Date of Patent: Jul. 24, 2001

(54) MULTIPLE BAND ANTENNA

(75) Inventor: Francis A. Stengel, Jr., Lancaster, NY (US)

(73) Assignee: Sti-Co Industries, Inc., Orchard Park, NY (US)

( * ) Notice: Subject to any disclaimer, the term of this patent is extended or adjusted under 35 U.S.C. 154(b) by 0 days.

(21) Appl. No.: 09/364,478

(22) Filed: Jul. 30, 1999

Related U.S. Application Data

(60) Provisional application No. 60/094,917, filed on Jul. 31, 1998.

(51) Int. Cl.[7] ..... H01Q 9/40

(52) U.S. Cl. ..... 343/791; 343/874; 343/875; 343/895

(58) Field of Search ..... 343/791, 831, 343/874, 875, 878, 895, 715

(56) References Cited

U.S. PATENT DOCUMENTS

| | | | | |
|---|---|---|---|---|
| 3,950,757 | * | 4/1976 | Blass | 343/791 |
| 4,441,108 | * | 4/1984 | Ten Pas | 343/874 |
| 4,509,056 | * | 4/1985 | Ploussios | 343/791 |
| 4,968,991 | * | 11/1990 | Yamazaki | 343/715 |
| 5,311,201 | * | 5/1994 | Lillie et al. | 343/715 |
| 5,451,968 | * | 9/1995 | Emery | 343/878 |
| 5,798,736 | * | 8/1998 | Hall | 343/791 |
| 5,995,065 | * | 11/1999 | Kitchener et al. | 343/791 |
| 6,034,648 | * | 3/2000 | Hope | 343/791 |

* cited by examiner

*Primary Examiner*—Don Wong
*Assistant Examiner*—Thuy Vinh Tran
(74) *Attorney, Agent, or Firm*—Hodgson Russ LLP

(57) ABSTRACT

An antenna system characterized by decoupling the antenna mast for multiple bands by use of a quarter wave decoupling stub or by the use of a frequency relative trap. As a result the antenna has multiple resonances simultaneously. The foregoing also can be accomplished by selecting antenna mast lengths that are harmonically related to provide a single element with multiple resonances without external devices. A diplexer comprising the combination of high and low pass filters and a broadcast coupler can be connected to the antenna feed point with transceivers operating in the different bands being connected to the high and low pass filters. The simultaneous multiple resonances ensure a matched impedance at the antenna feed point so that when a communications device is connected by a length of coax to the antenna feed point the matched impedance will be maintained at the feed point regardless of the length of the coax.

16 Claims, 3 Drawing Sheets

MULTIPLE BAND ANTENNA

CROSS REFERENCE TO A RELATED APPLICATION

Applicant hereby claims priority based on Provisional Application No. 60/094,917 filed Jul. 31, 1998 and entitled "Multiple Band Antenna" which is incorporated by reference.

BACKGROUND OF THE INVENTION

This invention relates to the art of antennas for radios and communications equipment located in vehicles, and more particularly to a new and improved antenna system having multiple band, broad band operation.

There are many instances when it is desirable to operate commercial radio transmitters from a motor vehicle while remaining covert or undercover. There are times when the need to operate more than one band is also required. Another purpose for using one antenna installation has no covert application, however the cost factor does enter into the picture. One antenna installation costs half as much as two installations. This is true financially and time wise also. There are several combinations that are standard:

Low Band/High Band

Low Band/UHF Band

High Band/UHF Band

High Band/800 MHz to 900 MHz

High Band/900 MHz to 970 MHz

Uhf Band/800 MHz to 900 MHz

UHF Band/900 MHz to 970 MHz

Cellular Band/PCS Band

The foregoing band combinations are a partial list of the band combinations possible using these techniques, but should not be considered a complete listing. As new bands become available for communications these methods can be used to operate multiple bands from one antenna while remaining covert or less expensive.

SUMMARY OF THE INVENTION

The present invention provides an antenna system having one or more of the following characteristics or features:

Disguised Antenna System;

Dual band operation;

Broad band operation;

Isolation between transceivers to eliminate the need for change over switches or relays; and Built in broadcast coupler The foregoing can be provided by decoupling the antenna mast for multiple bands by use of a quarter wave decoupling stub or by the use of a frequency selective trap. As a result the antenna has multiple resonances simultaneously. The foregoing also can be accomplished by selecting antenna mast lengths that are harmonically related to provide a single element with multiple resonances without external devices. A diplexer comprising the combination of high and low pass filters and a broadcast coupler can be connected to the antenna feed point with transceivers operating in the different bands being connected to the high and low pass filters. The simultaneous multiple resonances ensure a matched impedance at the antenna feed point so that when a communications device is connected by a length of coax to the antenna feed point the matched impedance will be maintained at the feed point regardless of the length of the coax.

The following detailed description of the invention, when read in conjunction with the accompanying drawings, is in such full, clear, concise and exact terms as to enable any person skilled in the art to which it pertains, or with which it is most nearly connected, to make and use the invention.

DETAILED DESCRIPTION OF THE INVENTION

Figure 1:
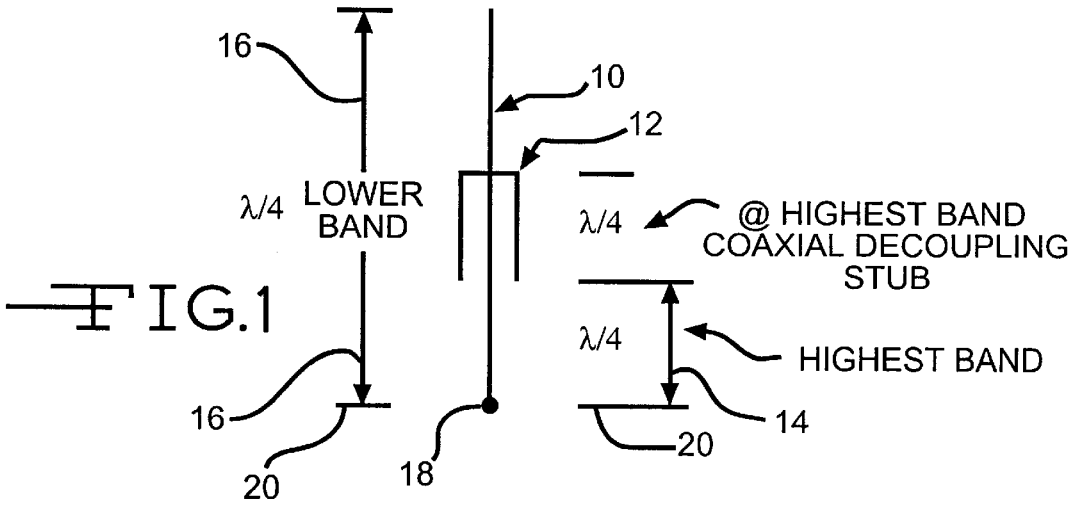
FIG. 1 is a schematic diagram of a multiple band antenna system according to the present invention.

The antenna system of the present invention can be made to be dual band using one or more of the following methods illustrated in FIGS. 1–5. Referring first to FIG. 1, an antenna 10 is provided with a quarter wavelength coaxial decoupling stub 12 at the highest frequency band. The antenna 10 has a primary section designated 14 which is resonant at the highest frequency band and has a length of a quarter wavelength at that highest frequency. The antenna 10 also has a secondary section designated 16 which is resonant at the lowest frequency band and has a length of a quarter wavelength at that lowest frequency. The coaxial section 12 opens up the antenna 10 so that the secondary portion 16 has a negligible effect on the feed point 18 when the antenna sections 14 and 16 approach resonance. Section 12 also lowers the resonant frequency of section 16 such that the electrical length of section 16 appears longer than its physical length. The foregoing arrangement makes the antenna mast 10 have multiple resonances simultaneously. There is no frequency relationship and no harmonic is relationship between the highest and lowest resonances. The antenna ground or reference plane is designated 20 in FIG. 1.

Figure 2:
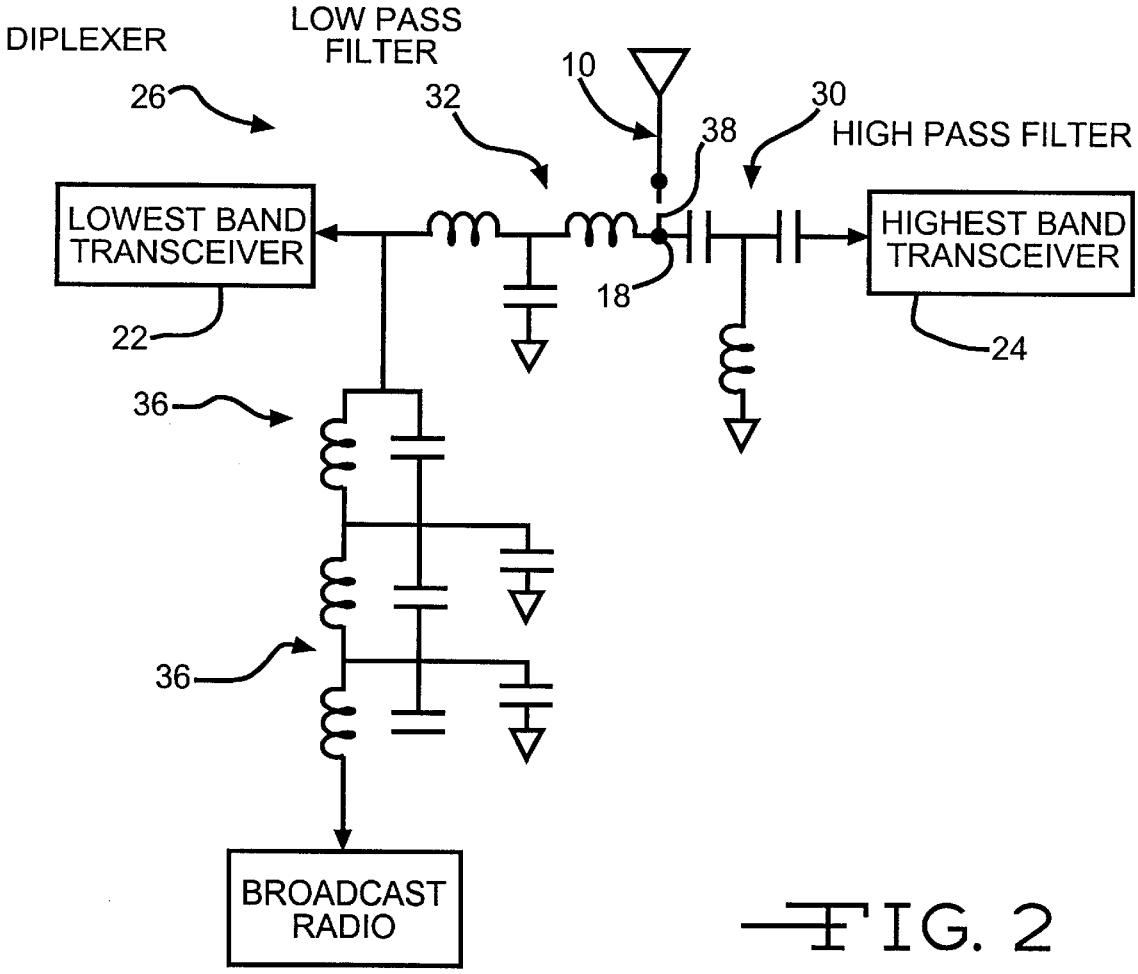
FIG. 2 is a schematic circuit diagram showing the antenna of FIG. 1 in combination with a diplexer and a pair of transceivers.

Thus, the antenna mast 10 can be decoupled for multiple bands through the use of quarter wave decoupling stub 12. This will provide an antenna system that will function on multiple bands. In order to make this antenna 10 covert the mast can be cast into a fiberglass or other non metallic composite resin material. This will provide an antenna with dual band covert capability. In order to make this type of antenna dual band broad band and provide isolation between transceivers 22 and 24, a diplexer 26 must be used as shown in FIG. 2. The diplexer should consist of three filter sections. The two primary filters should be built up using one high pass filter 30 and one low pass filter 32. These filters are connected together at the antenna port on feed point 18 and connected to the transceivers 22, 24 at the non-common end. The broadcast output is taken from the output of the low pass filter 32 via a second low pass filter 36. When the original high and low pass filters are designed they should be designed to provide a minimum of approximately 36 Db isolation and an SWR (standing wave ratio) not exceeding 2:1 across both bands. Actual isolation will depend upon receiver sensitivity and transmitter power. The broadcast coupler low pass filter 36 must provide at least approximately 40 Db between the high end of the FM broadcast band and the low end of the communications band. Actual isolation will depend upon transmitter power and receiver sensitivity. The broadcast coupler provides a high degree of isolation and low insertion loss at the broadcast band. It may be viewed as a band pass filter to pass the broadcast signal and designed with low capacitance elements to minimize AM loss of signal.

The antenna system of the present invention advantageously solves the problem that in modern automobiles it is not possible to physically locate the matching networks at the base of the antenna. In the antenna system of the present invention, the diplexer 26 can be connected to antenna feed point 18 by a length of coax and therefore situated in a physically convenient location in the automobile. By having antenna 10 resonant at both frequencies this ensures a matched impedance at feed point 18 so that there always will be a matched condition regardless of the length of the coax connecting the diplexer 26 or similar communications device to the feed point 18. In other words, having the matched impedance at feed point 18 makes the length of the coax less relevant.

In order to have the foregoing antenna system broad band, wherein diplexer 26 is connected to feed point 18 by a length of coax, shown by the broken line 38 in FIG. 2, the length of the coax 38 and the characteristics of the high and low pass filters 30 and 32 are adjusted to complement each other. This enables the antenna system to achieve broad band performance at both frequencies simultaneously.

Figure 3:
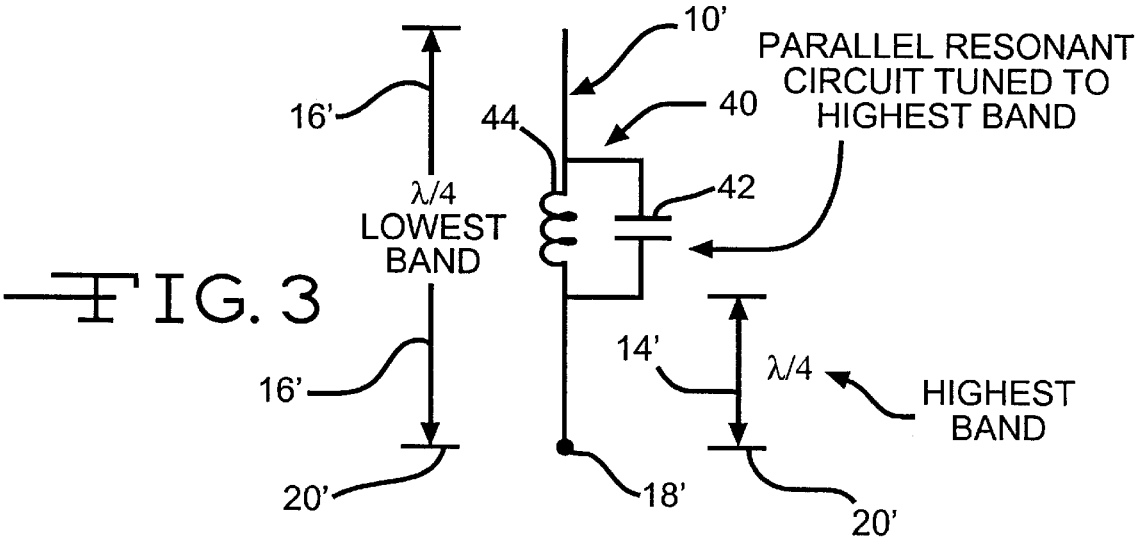
FIG. 3 is a schematic diagram of an alternative embodiment of the antenna in the system of FIG. 1.
Figure 4:
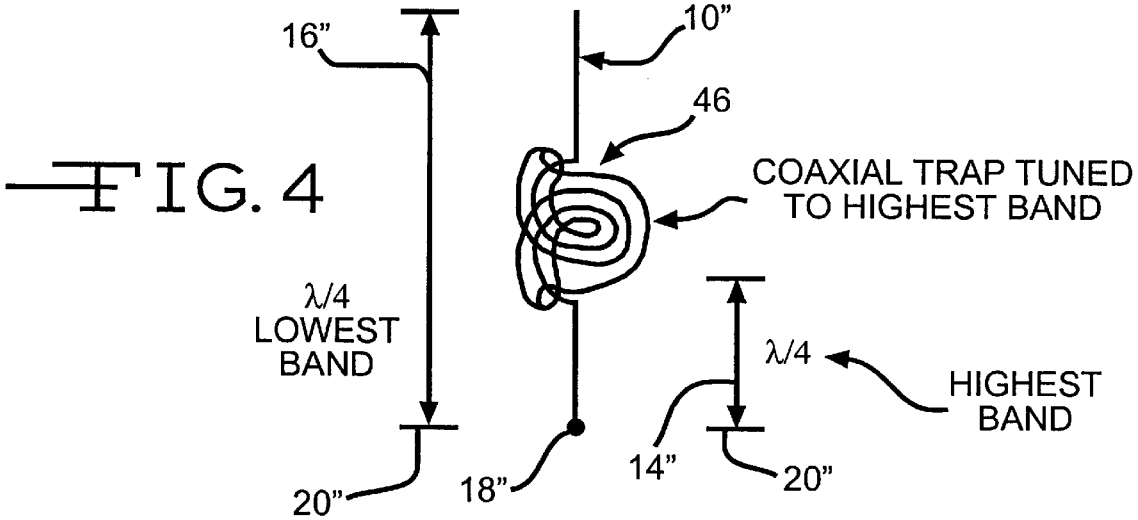
FIG. 4 is a schematic diagram of another alternative embodiment of the antenna in the system of FIG. 1.
Figure 5:
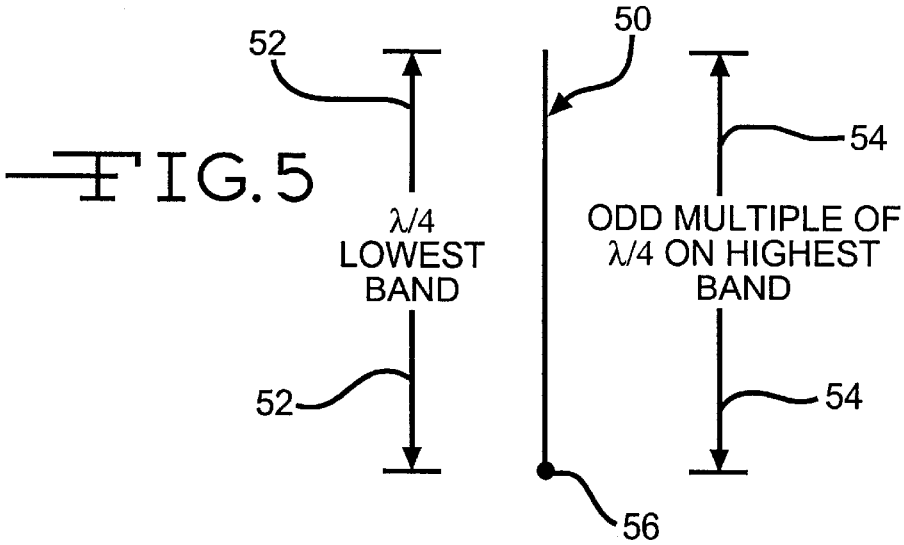
FIG. 5 is a schematic diagram of another embodiment of the antenna in the system of FIG. 1.
Figure 6:
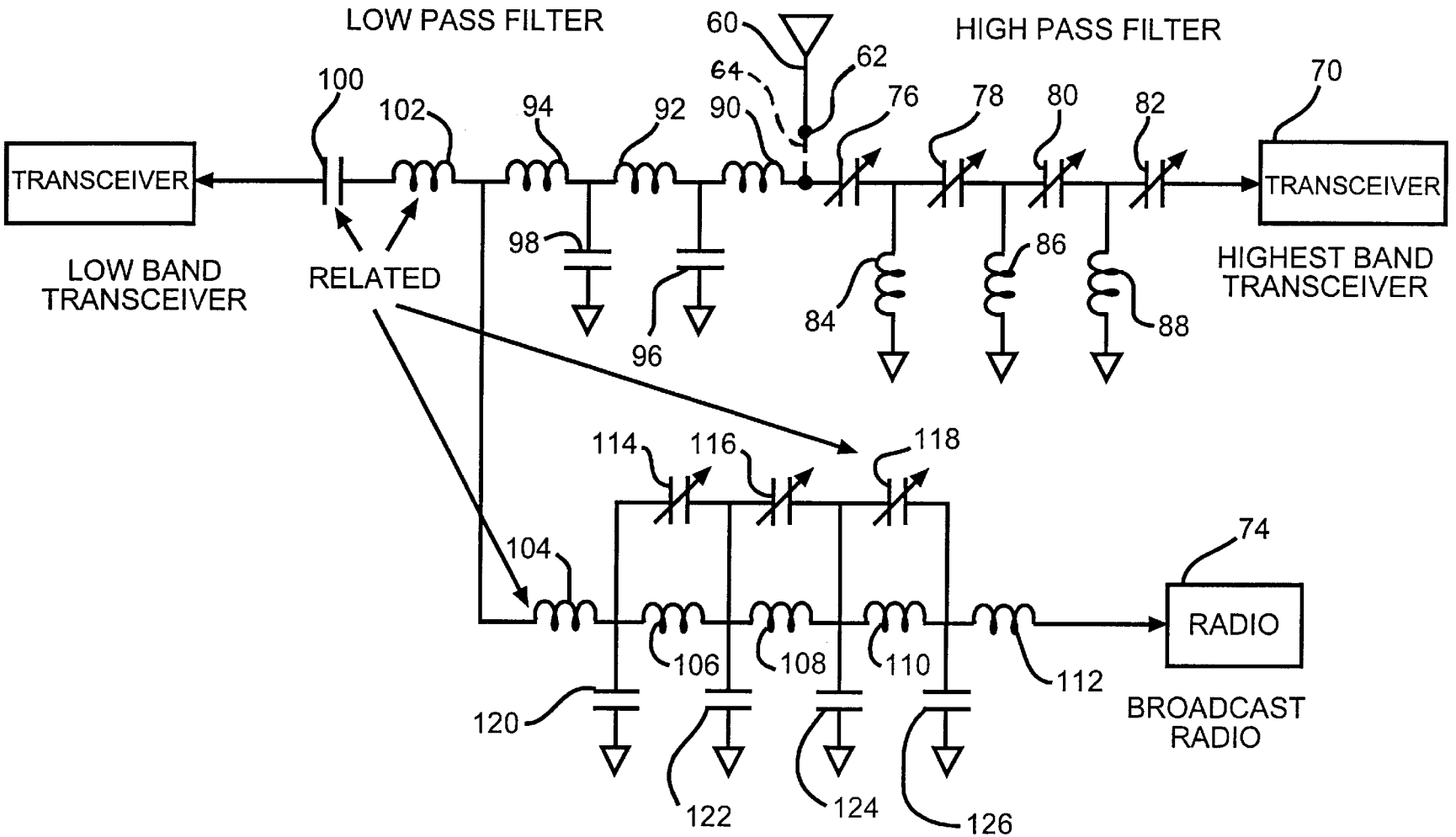
FIG. 6 is a schematic circuit diagram further illustrating the antenna of the present invention.

FIGS. 3–5 illustrate alternative approaches whereby the antenna system can be made dual band. In particular, a second method of obtaining the dual band operation is the use of frequency selective traps in the mast to provide a dual frequency resonance. These traps can be either coils and capacitors or coaxial cable properly inserted and connected in the antenna structure. The use of the diplexer will provide the necessary isolation and broad banding. The filter will also provide the output port for the broadcast radio.

Thus, antenna 10' shown in FIG. 3 is provided with a parallel resonant circuit 40 comprising capacitor 42 and inductor 44 tuned to the highest band. The primary section 14' between resonant circuit 40 and feed point 18' is resonant at the highest frequency band and has a length of a quarter wavelength at that highest frequency. The secondary section 16' between feed point 18' and the opposite end of antenna 10' is resonant at the lowest frequency band and has a length of a quarter wavelength at that lowest frequency. Antenna 10" shown in FIG. 4 is provided with a coaxial trap 46 tuned to the highest band. Trap 46 is tuned by selecting the length of coax that is wound or unwrapped to form the trap. The primary section 14' between coaxial trap 46 and feed point 18" is resonant at the highest frequency band and has a length of a quarter wavelength at that highest frequency. The secondary section 16" between feed point 18" and the opposite end of antenna 10" is resonant at the lowest frequency band and has a length of a quarter wavelength at that lowest frequency. The antennas 10' and 10" would be connected at the feed points 18' respectively, and 18" each to a diplexer comprising the combination of high and low pass filters and broadcast couplers in a manner similar to the system of FIG. 2. Likewise each diplexer can be located remote from the antenna, being connected by a length of coax, in a manner similar to that of the system of FIG. 2, and each antenna 10', 10" can be made broad band in a manner similar to that described in connection with FIG. 2.

In the antenna system illustrated in FIGS. 1–4, there is no need for any harmonic relationship between the multiple resonances. A third method of providing the necessary multiple band operation is to use antenna mast lengths that are harmonically related to provide a single element with multiple resonances without external devices. An example of this method would be a ¼ wave antenna mast for VHF Band and ¾ wave mast for UHF Band. Thus, in the antenna 50 shown in FIG. 5, the mast length designated 52 is a quarter wavelength at the lowest frequency band and the mast length designated 54 is an odd multiple of a quarter wavelength at the highest frequency band. Accordingly, in contrast to the antennas illustrated in FIGS. 1–4, the antenna 50 of FIG. 5 has need for a harmonic relationship which is the odd harmonics 3, 5, 7, 9, etc. For example, the quarter wavelength mast at 150 MHZ would require a three quarter wavelength mast at the other band which is three times the lower frequency or 450 MHZ, or a five quarter wavelength mast at the other band which is five times the lower frequency or 750 MHZ, etc.

As in the embodiments of FIGS. 1–3, antenna 50 would be connected at the feed point 56 to a diplexer comprising the combination of high and low pass filters and a broadcast coupler. Likewise, antenna 50 and the diplexer can be at different physical locations with the remotely located diplexer being connected by a length of coax to the feed point 56, and antenna 50 can be made broad band in a manner similar to that described in connection with FIG. 1.

In the embodiments of FIGS. 1–5 the broadcast radio and broadcast coupler 36 can be omitted so that the antenna is operated with only the pair of transceivers. Furthermore, the system could be operated by transmitting on one of the frequency bands and receiving on the other frequency band. This would be done mainly at low power to avoid interference, low power being defined by the isolation parameters of the diplexer. As further alternatives, the system could be operated with receivers on both frequency bands or with transmitters on both frequency bands. By way of example, the antenna system of the present invention could enable the broad band antenna to be located on a tower with a single coax connecting the antenna feed point to a diplexer and transmitters or receivers located at the base of the tower. This would avoid the need to provide a pair of expensive coax sections on the tower as has been done in prior art arrangements.

The various methods shown and described in connection with FIGS. 1–5 are different ways of achieving multiple resonance in the antenna of the present invention. In an effort to meet all of the criteria stated above it is necessary to use one of the multi band techniques shown. The need for broad banding requires the diplexer to be designed to be a matching filter as well as an isolation filter. This means the common (antenna) port is not normally 50 ohms across the entire bandwidth of both of the bands, but requires correction to a nominal 50 ohms by the action of the filter. The need for isolation between both receivers and or transmitters along with the broadcast cannot be forgotten. In addition, while the antenna according to the present invention has been described in connection with the dual resonances, multiple resonance, i.e. three, four, etc. are intended to be included within the scope of the present invention. For example, for three bands the antenna is tuned at the highest of the three bands and at the next highest band. The resonance of the lowest band is established by the overall length of the monopole. The physical length of the antenna is slightly less as modified by the coaxial stub or the like.

The present invention is illustrated further by the following example of the circuit of FIG. 5. Antenna 60 is similar to antennas 10, 10', 10" or 50 shown in FIGS. 1–4. The antenna feedpoint 62 is connected either directly or through a section of coax 64 to a diplexer similar to that of FIG. 2. The diplexer, in turn, includes high and low pass filters for the high band (UHF at 400–420 MHZ)and low band (VHF at 150–174 MHZ)transceivers 70 and 72, respectively, and another low pass filter or broadcast coupler for the broadcast radio 74. The high pass filter for transceiver 70 comprises variable capacitors 76, 78, 80 and 82 each of which can have a magnitude ranging from 0.1–8 picofarads and inductors 84, 86 and 88 each having a magnitude of 15 nanohenries. The low pass filter for transceiver 72 comprises inductors 90, 92 and 94 which can have magnitudes of 40, 22 and 106 nanohenries, respectively, and capacitors 96 and 98 each having a magnitude ranging from 0.5 to 14 picofarads. The low pass filter for broadcast radio 74 includes the combination of capacitor 100 and inductor 102 together with the network of inductors 104, 106, 108, 110 and 112, variable capacitors 114, 116, 118 and capacitors 120, 122, 124 and 126. Capacitor 100 can have a magnitude of 5.6 picofarads and inductor 102 can have a magnitude of 88 nanohenries. Inductors 104, 106, 108, 110 and 112 can have magnitudes of 20, 94, 158, 158 and 20 nanohanries, respectively. Variable capacitors 114, 116 and 118 each can have a magnitude ranging from 0.1–8 picofarads. Capacitors 120, 122, 124 and 126 can have magnitudes of 24, 48, 57 and 48 picofarads, respectively. The foregoing dual based antenna, diplexer, transceivers and broadcast radio is an example of an illustrative arrangement installed in a vehicle wherein the antenna is disguised for covert operation. The foregoing inductor and capacitor values are approximate and are adjusted for each vehicle type.

It is therefore apparent that the present invention accomplishes its intended objectives. While embodiments of the present invention have been described in detail, that has been done for the purpose of illustration, not limitation.

What is claimed is:

1. A dual band antenna comprising:

a) an antenna mast having a feed point at one end and having an opposite end;

b) a quarter wavelength coaxial decoupling stub on said antenna mast between said ends of said mast and tuned to the highest frequency band;

c) said antenna having a primary section between said stub and said feed point which is resonant at the highest frequency band and which has a length of a quarter wavelength at the frequency of the highest frequency band; and d) said antenna having a secondary section between said feed point and the opposite end of said antenna which is resonant at the lowest frequency band and which has a length of a quarter wavelength at the frequency of the lowest frequency band;

e) so that said antenna has multiple resonances simultaneously.

2. The antenna of claim 1, wherein a diplexer comprising the combination of high and low pass filters and a broadcast coupler is connected to said antenna feed point.

3. The antenna of claim 2, wherein transceivers operating in said highest frequency band and in said lowest frequency band are connected to said high and low pass filters, respectively.

4. The antenna of claim 1, wherein the simultaneous multiple resonances ensure a matched impedance at said antenna feed point so that when a communications device is coupled by a length of coax to said antenna feed point the matched impedance will be maintained at said feed point regardless of the length of the coax.

5. A dual band antenna comprising:

f) an antenna mast having a feed point at one end;

g) a frequency selective trap on said antenna mast in series electrically with said mast and tuned to the highest frequency band;

h) said antenna having a primary section between said trap and said feed point which is resonant at the highest frequency band and which has a length of a quarter wavelength at the frequency of the highest frequency band; and i) said antenna having a secondary section between said feed point and the opposite end of said antenna which is resonant at the lowest frequency band and which has a length of a quarter wavelength at the frequency of the lowest frequency band; and j) so that said antenna has multiple resonances simultaneously.

6. The antenna according to claim 5, wherein said frequency selective trap comprises a parallel resonant circuit tuned to the highest frequency band.

7. The antenna according to claim 5, wherein said frequency selective trap comprises a coaxial trap tuned to the highest frequency band.

8. The antenna of claim 5, wherein a diplexer comprising the combination of high and low pass filters and a broadcast coupler is connected to said antenna feed point.

9. The antenna of claim 8, wherein transceivers operating in said highest frequency band and in said lowest frequency band are connected to said high and low pass filters, respectively.

10. The antenna of claim 5, wherein the simultaneous multiple resonances ensure a matched impedance at said antenna feed point so that when a communications device is coupled by a length of coax to said antenna feed point the matched impedance will be maintained at said feed point regardless of the length of the coax.

11. The antenna of claim 5, wherein said antenna mast has another end and wherein said frequency selective trap is between said ends of said antenna mast.

12. A dual band antenna comprising a mast having a feed point at one end and an opposite end, said antenna having multiple resonances harmonically related, said antenna having a length between said feed point and said opposite end selected to be one quarter wavelength at the lowest frequency band and an odd multiple of a quarter wavelength at the highest frequency band.

13. The antenna of claim 12, wherein said lowest frequency band is the VHF band and said highest frequency band is the UHF band.

14. The antenna of claim 12 wherein a diplexer comprising the combination of high and low pass filters and a broadcast coupler is connected to said antenna feed point.

15. The antenna of claim 12, wherein transceivers operating in said highest frequency band and in said lowest frequency band are connected to said high and low pass filters, respectively.

16. The antenna of claim 12, wherein the simultaneous multiple resonances ensure a matched impedance at said antenna feed point so that where a communications device is coupled by a length of coax to said antenna feed point the matched impedance will be maintained at said feed point regardless of the length of the coax.

* * * * *